US008276749B1

(12) United States Patent
Schrauwen et al.

(10) Patent No.: US 8,276,749 B1
(45) Date of Patent: Oct. 2, 2012

(54) PORTABLE ASHTRAY APPARATUS

(76) Inventors: Amanda Schrauwen, Los Angeles, CA (US); Nicholas Y. Schrauwen, Los Angeles, CA (US)

( * ) Notice: Subject to any disclaimer, the term of this patent is extended or adjusted under 35 U.S.C. 154(b) by 0 days.

(21) Appl. No.: 13/298,700

(22) Filed: Nov. 17, 2011

(51) Int. Cl.
*B65D 50/06* (2006.01)

(52) U.S. Cl. ..... 206/246; 206/242; 206/217

(58) Field of Classification Search ..... 206/246, 206/217, 242; 131/231, 238
See application file for complete search history.

(56) References Cited

U.S. PATENT DOCUMENTS

| | | | | | |
|---|---|---|---|---|---|
| 1,184,881 | A * | 5/1916 | Schumacher | 131/238 |
| 1,695,346 | A * | 12/1928 | Reese | 131/231 |
| 1,719,925 | A * | 7/1929 | Cruess | 131/231 |
| 1,737,644 | A * | 12/1929 | Conner | 131/238 |
| 2,087,360 | A * | 7/1937 | Shekerjian | 206/526 |
| 2,595,103 | A * | 4/1952 | Schmaling, Sr. | 131/242 |
| 2,786,595 | A * | 3/1957 | Nelson | 220/212 |
| 2,842,280 | A * | 7/1958 | Nelson | 220/576 |
| 3,078,854 | A * | 2/1963 | Arthur | 131/256 |
| 3,191,608 | A * | 6/1965 | Licata | 131/256 |
| 3,451,533 | A * | 6/1969 | Butler | 206/246 |
| 3,904,070 | A * | 9/1975 | Lisciani et al. | 220/88.1 |
| 3,952,753 | A * | 4/1976 | Klingler | 131/235.1 |
| 4,346,719 | A * | 8/1982 | Hilkene | 131/236 |
| 4,534,369 | A * | 8/1985 | Jenkins | 131/235.1 |
| 4,534,370 | A * | 8/1985 | Saxby | 131/237 |
| 5,038,801 | A * | 8/1991 | Wang | 131/236 |
| 5,159,941 | A * | 11/1992 | Tornatore | 131/236 |
| 5,906,314 | A * | 5/1999 | Kinay | 232/43.1 |
| 6,460,761 | B1 * | 10/2002 | Fraga et al. | 232/43.1 |
| 2005/0087200 | A1 * | 4/2005 | Savietto | 131/231 |
| 2008/0121243 | A1 * | 5/2008 | Galoyan | 131/231 |

* cited by examiner

*Primary Examiner* — Steven A. Reynolds
*Assistant Examiner* — King M Chu
(74) *Attorney, Agent, or Firm* — Jason T. Daniel, Esq.; Daniel Law Offices, P.A.

(57) ABSTRACT

A portable ashtray apparatus includes a main body having an open top, and a cavernous interior space for housing a removable container. The apparatus also includes a funnel cap secured to both the main body and the removable container in order to receive spent cigarettes and other like items and direct the same into the container for disposal. The apparatus also includes a solution for extinguishing embers and emanating aromatically friendly scents.

12 Claims, 3 Drawing Sheets

PORTABLE ASHTRAY APPARATUS

BACKGROUND

Field of the Invention

The present invention relates generally to ashtrays, and more particularly to an ashtray apparatus having a removable container capable of housing a solution and disposing of cigarettes and other like items.

Ashtrays and their associated uses are well known in the art. Although the ashtray originated as a basic open top bowl for storing ashes and spent cigarettes/cigars, improvements to the various designs of the ashtray have seen features designed to allow greater mobility, safety and convenience.

While such designs have been developed, there have been many drawbacks associated with the prior designs. For example, prior designs generally included a central cavity/bowl which may or may not contain a fluid for extinguishing spent cigarettes and the like. However, when the central cavity becomes filled to capacity, it is necessary for a user to manually clean the cavity which is unhygienic and can be extremely messy. Additionally, when repeatedly utilizing a cavity for storage of aromatically offending items, it is common for the device itself to emanate the unfriendly odors which may offend a user. To this end, products utilizing the prior art are often discarded long before the useful lifespan has been expended, which is ecologically unfriendly.

Accordingly, there remains a need for a portable ashtray apparatus having the benefits of the prior art without the drawbacks.

SUMMARY OF THE INVENTION

The present invention is directed to a portable ashtray apparatus. One embodiment of the present invention can include a main body having an open top, and a cavernous interior space for housing a removable container. The apparatus also includes a funnel cap secured to both the main body and the removable container in order to receive spent cigarettes and other like items and direct the same into the container for disposal.

Another embodiment of the present invention can include a solution capable of extinguishing embers and emanating a pleasant aromatic scent.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
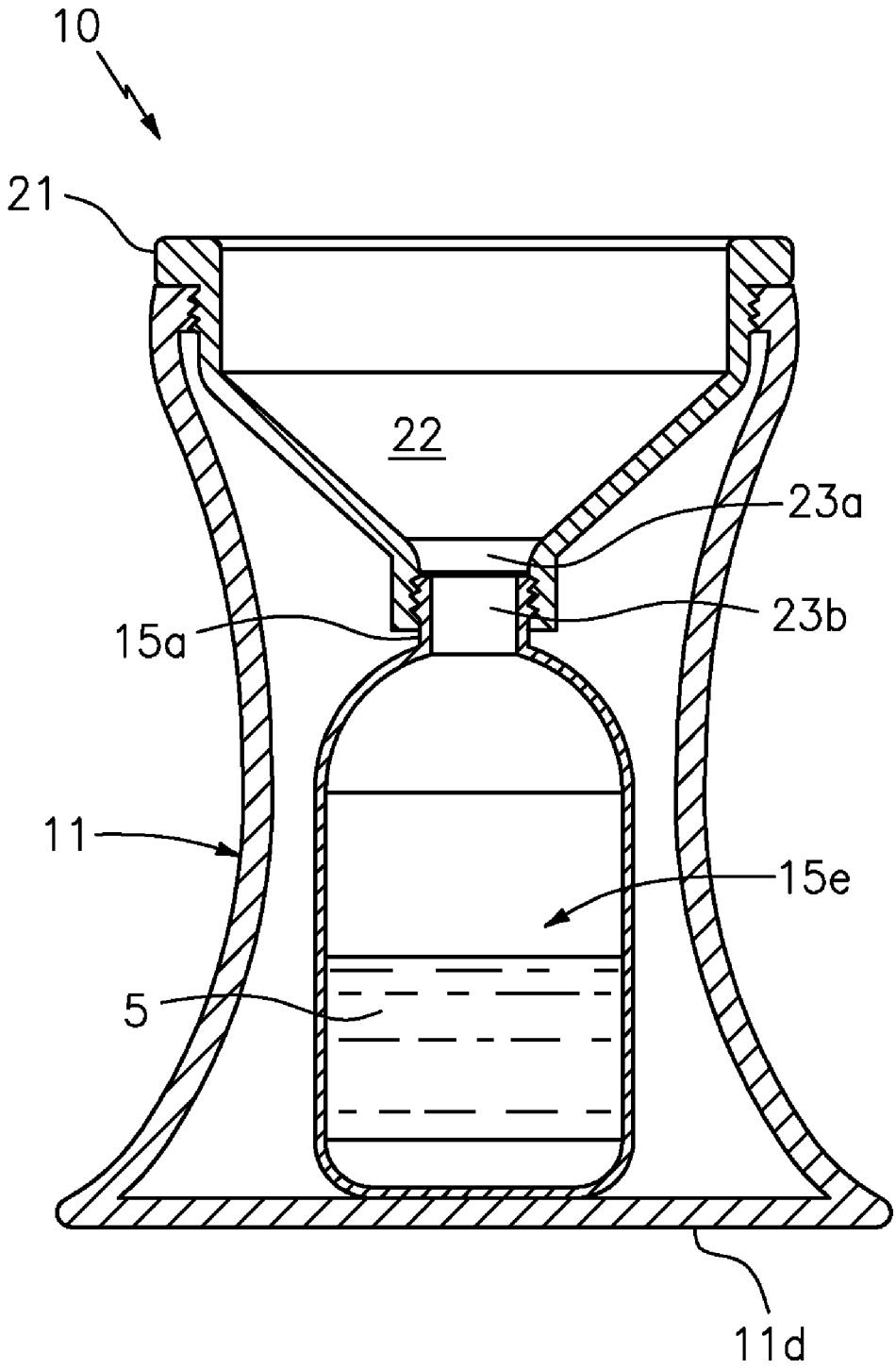
FIG. 1 is a frontal elevation of a portable ashtray apparatus that is useful for understanding the inventive concepts disclosed herein.

For purposes of this description, the terms "upper," "bottom," "right," "left," "front," "vertical," "horizontal," and derivatives thereof shall relate to the invention as oriented in FIG. 1.

Figure 2:
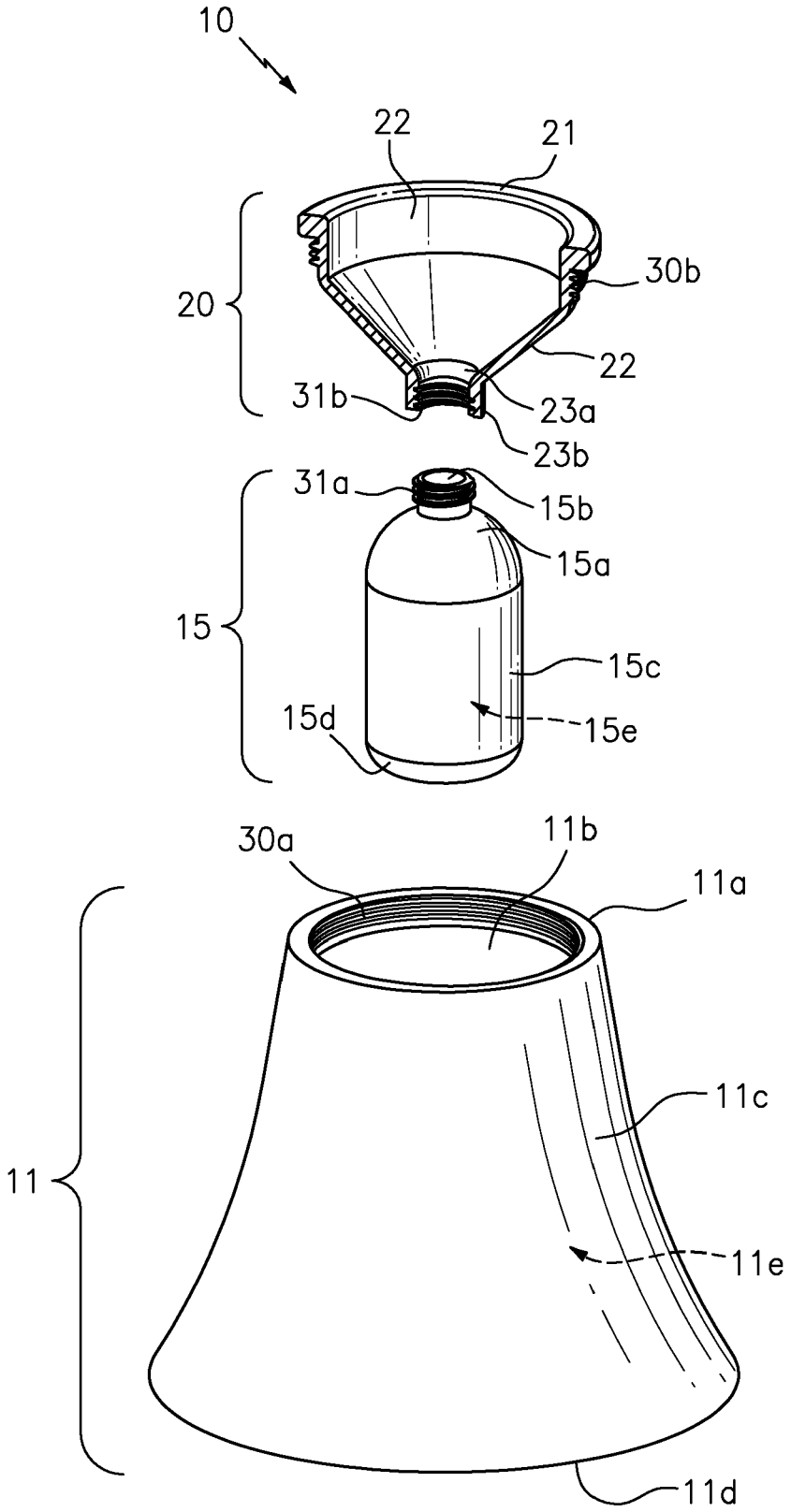
FIG. 2 is an exploded parts view of a portable ashtray apparatus according to one embodiment of the invention.
Figure 3:
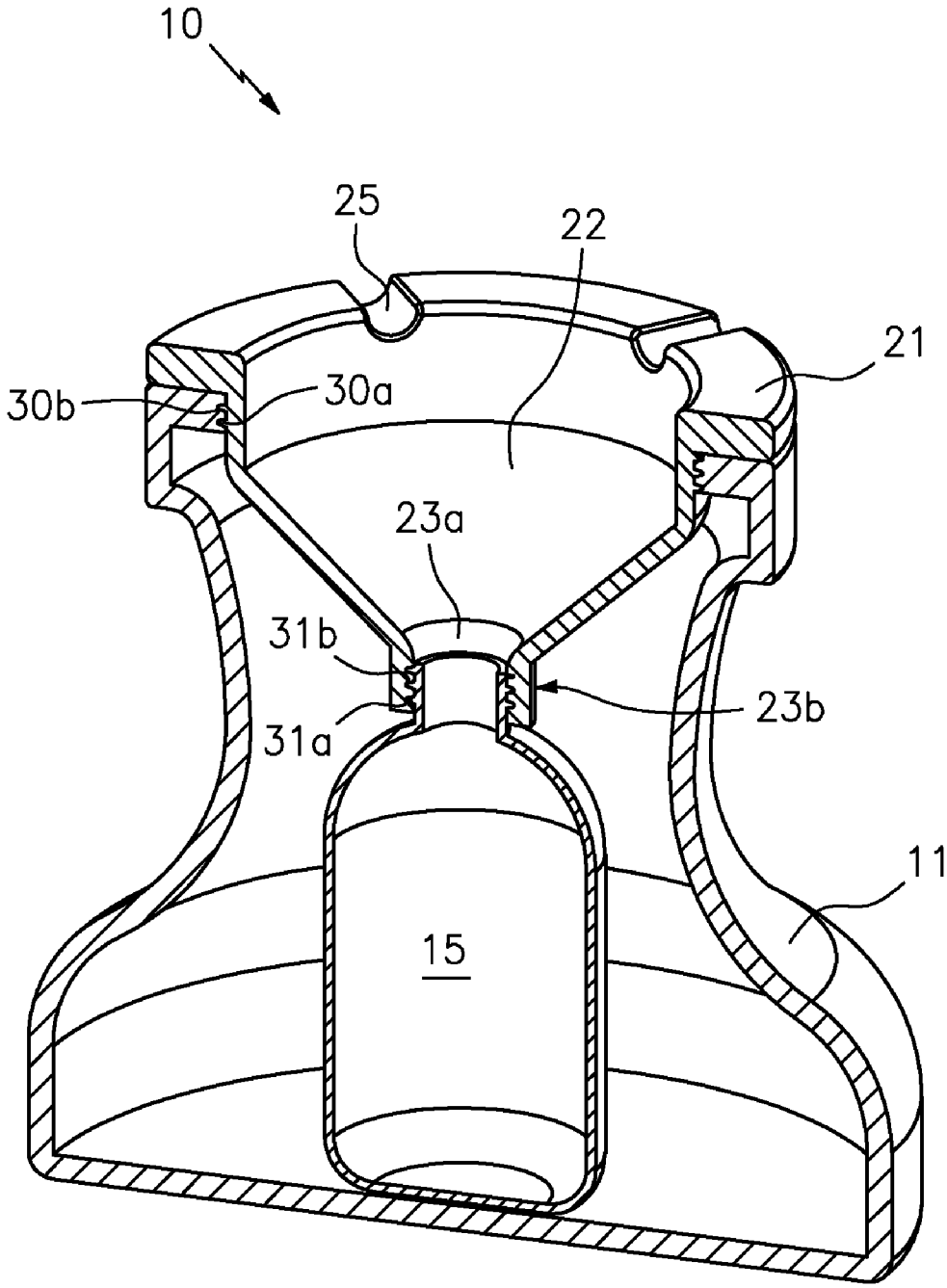
FIG. 3 is a cutout view of a portable ashtray apparatus according to one embodiment of the invention.

FIGS. 1-3 illustrate one embodiment of a portable ashtray apparatus 10 that is useful for understanding the inventive concepts disclosed herein. As shown, the apparatus 10 can include a main body 11, a removable container 15 and a funnel cap 20.

The main body 11 can act as the outer shell for housing the components of the apparatus. The main body itself can take any number of distinct shapes and sizes, and can be constructed from any number of known materials and methods. In one preferred embodiment, main body 11 can be constructed from injection molded plastic, however other known materials such as steel, rigid plastic and/or composite materials, along with the corresponding manufacturing processes are also contemplated.

As shown, the main body 11 can include a top section 11*a*, a middle section 11*c* and a capped, generally flat bottom section 11*d*, each defining a hollow cavity 11*e*. Positioned within the central area of the top section 11*a* is an opening 11*b* for allowing access to the cavity 11*d*.

In one preferred embodiment, the top section of the main body 11*a* can further include a connector in the form of a plurality of threads 30*a* for allowing the main body 11 to be removably secured to the funnel top 20. Additionally, it is preferred that the bottom section of the main body 11*d* include a greater width than the top section 11*a*, in order to lower the center of gravity and to prevent the apparatus from easily tipping over.

In one alternate embodiment (not illustrated) the apparatus 10 can include an overall size and shape suitable for allowing the main body 11 to be deposited into the drink holder of a vehicle.

The removable container 15 can act as a vessel for storing and extinguishing spent cigarettes, cigars, matches, ashes and the like. In one embodiment, the container 15 will include a bottle-like design having a narrow top portion 15*a*, a connector in the form of plurality of threads 31*a*, a middle portion 15*c* and a capped bottom portion 15*d*, defining a waterproof storage space 15*e*. An opening 15*b* will be provided at or near the center of the top portion 15*a* for allowing access to the storage space 15*d*.

In one preferred embodiment, the removable container 15 can be constructed from injection molded plastic and will include both a horizontal and vertical size that is capable of being removably inserted through the opening 11*b*, and stored within the cavity 11*e* of the main body.

Alternatively, the container 15 can be disposable in nature and constructed from recyclable or biodegradable material, which will act to reduce waste, and further enhance the environmentally friendly aspects of the device The funnel cap 20 can act as a channel for directing cigarettes and the like into the waterproof storage space 15*d*. In one embodiment, the funnel cap 20 can include an outer rim 21, bounding an inwardly sloping surface 22 terminating at a central channel 23 having an upper portion 23*a* and a lower portion 23*b*. The sloping surface 22 can utilize gravity to force any ashes and/or spent cigarettes and the like down into the lower portion for storage and removal via the container 15. As shown in FIG. 3, the funnel cap can also include one or more optional cigarette retaining regions.

In one preferred embodiment, the funnel cap 20 can be constructed from hardened plastic having an extremely high combustion temperature. Of course other non-flammable materials can also be utilized such as steel, and aluminum, for example. A connector in the form of a plurality of threaded elements 30*b* can be disposed along the outer rim 21 in order to engage the threads 30*a* of the main body 11 in a conventional manner. Accordingly, in one embodiment, the structure of the funnel cap 20 will include an outside diameter sufficient to receive the top portion of the main body 11*a*. Likewise, the lower portion of the central channel can also include a connector in the form of a plurality of threaded elements 31*b* for engaging the threads 31*a* of the removable container.

Although described above as utilizing threaded elements 30*a*-30*b*, and 31*a*-31*b*, capable of creating a secure attachment point between two objects when a rotational force is applied thereto, this is for illustrative purposes only, as any number of known connectors and components capable of creating a removable seal between two items can also be utilized. Accordingly, the apparatus is not limited to using threaded elements.

In one embodiment, the removable waterproof container 15 can house a solution 5 capable of immediately extinguishing any flames or embers originating from cigarettes and other like items that are deposited into the apparatus. Additionally, it is known that when cigarettes and other like items are immersed in fluid, the physical structure of the cigarette will quickly degrade, thus greatly increasing the capacity of the storage space 15*e*, as opposed to a dry container where the shape of the deposited cigarette is not altered/decomposed.

In one preferred embodiment, the solution 5 will be in the form of a non-flammable liquid (such as water) which can also include an aromatic agent such as lemon extract, for example, that is designed to remove any unpleasant odors from emanating from the container 15. Of course other solutions such as gel, foam and the like, along with an unlimited number of aromatic agents can also be utilized herein.

In operation, the apparatus 10 can function as a traditional ashtray in which a user can deposit ashes, cigarettes and the like onto the funnel cap. The ashes will then be routed down the sloped surface 22, through the channel 23 and into the removable container 15, where any existing flame will be extinguished by the solution 5. After repeated use and/or when desirable to a user, the apparatus 10 can be emptied by separating the funnel top from the main body 11, via the connectors 30*a* and 30*b*. The container 15 can then be removed from the main body via the opening 11*b*, and then separated from the funnel cap via connectors 31*a* and 31*b*. The spent container can be disposed of, and a new container 15 which may or may not contain a fresh solution 5 can be secured within the apparatus by reversing the above described steps.

Alternatively, the device can also be utilized, if so chosen, without the removable cartridge 15. To this end, the hollow cavity 11*e* of the main body can act as a vessel for directly storing spent cigarettes and the like without utilizing the removable container. Such a feature may be useful when the apparatus 10 is at the end of its useful lifespan, and the user is no longer concerned with contaminating the main body, prior to disposal.

Accordingly, by providing a removable and disposable central container 15, the device allows a user to safely and hygienically extinguish, store and remove spent cigarettes and the like without having to come into direct contact with the spent articles. Additionally, the apparatus allows a user to repeatedly utilize the main body and funnel cap throughout the useful lifespan of each component which reduces waste.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A portable ashtray apparatus, comprising:

a main body that includes a top section, a middle section, a bottom section and a cavernous interior, said top section further including an opening that is in communication with the cavernous interior;

a removable container having an elongated, generally bottle-like shape that is configured to retain a foreign object, said container including a top section, a middle section, a bottom section and an elongated cavernous waterproof space, said top section further including an opening that is in communication with the waterproof space;

a cap having an outer rim defining a sloping surface and a central channel having a top end and a bottom end, the outer rim of said cap being removably secured to the top section of the main body; and a connector interposed between the bottom end of the central channel and the top end of the removable container, said connector forming a pathway for depositing the foreign object into the waterproof space of the removable container, wherein said connector includes a plurality of threaded elements disposed onto each of the channel and the top of the removable container, said threads being configured to engage and disengage when a twisting motion is imparted thereon.

2. The portable ashtray apparatus of claim 1, wherein the removable container is disposable.

3. The portable ashtray apparatus of claim 1, further comprising a solution configured to extinguish an ember.

4. The portable ashtray apparatus of claim 3, wherein the solution is liquid.

5. The portable ashtray apparatus of claim 3, wherein the solution is at least one of a gel and a foam.

6. The portable ashtray apparatus of claim 2, wherein the solution further includes an aromatic agent.

7. The portable ashtray apparatus of claim 1, further comprising a plurality of connectors configured to removably secure the cap and the main body.

8. The portable ashtray apparatus of claim 1, wherein the removable container is configured to pass through the opening of the main body.

9. The portable ashtray apparatus of claim 1, wherein a dimension of the bottom section of the main body is greater than a dimension of each of the top section and middle section of the main body.

10. The portable ashtray apparatus of claim 1, wherein the main body is configured to fit within a conventional drink holder of a vehicle.

11. The portable ashtray apparatus of claim 1, wherein the removable container is constructed from at least one of a recyclable material and a biodegradable material.

12. A portable ashtray apparatus comprising:

a main body that includes a top section, a middle section, a bottom section and a cavernous interior, said top section further including an opening that is in communication with the cavernous interior;

a removable container having an elongated, generally bottle-like shape that is configured to retain a foreign object, said container including a top section, a middle section, a bottom section and an elongated cavernous waterproof space, said top section further including an opening that is in communication with the waterproof space;

a solution configured to extinguish an ember, said solution being housed within the waterproof space of the removable container;

a cap having an outer rim defining a sloping surface and a central channel having a top end and a bottom end, the outer rim of said cap being removably secured to the top section of the main body; and a connector interposed between the bottom end of the central channel and the top end of the removable container, said connector forming a pathway for depositing the foreign object into the solution contained within the waterproof space of the removable container, wherein said connector includes a plurality of threaded elements disposed onto each of the channel and the top of the removable container, said threads being configured to engage and disengage when a twisting motion is imparted thereon.

* * * * *